United States Patent [19]

O'Dair

[11] 4,238,063

[45] Dec. 9, 1980

[54] SKI TRANSPORT CONTAINER

[76] Inventor: Timothy J. O'Dair, 6109 Gale Dr., Boulder, Colo. 80303

[21] Appl. No.: 3,266

[22] Filed: Jan. 15, 1979

[51] Int. Cl.[3] ..... A45C 5/12

[52] U.S. Cl. ..... 224/45 S; 206/315 R; 211/605 K; 224/328; 280/280/814

[58] Field of Search ..... 224/45 S, 319, 324, 224/323, 328; 280/11.37 K, 11.37 A, 11.37 E; 206/315 R, 317; 211/605 K, 60 G, 60 R, 68; 190/19, 24, 41 R, 51; 220/4

[56] References Cited

U.S. PATENT DOCUMENTS

| | | | |
|---|---|---|---|
| 2,650,449 | 9/1953 | Suring | 206/315 X |
| 2,964,166 | 12/1960 | Lehner et al. | 206/315 X |
| 3,399,009 | 8/1968 | Slade | 206/315 X |
| 3,767,036 | 10/1973 | McLeod | 224/45 S X |
| 3,848,785 | 11/1974 | Bott | 224/319 |
| 3,915,362 | 10/1975 | Hart | 224/328 |
| 3,921,871 | 11/1975 | Heil | 224/45 S |
| 4,084,735 | 4/1978 | Kappas | 280/11.37 K X |
| 4,126,254 | 11/1978 | Sahakian | 224/45 S |

FOREIGN PATENT DOCUMENTS

| | | | |
|---|---|---|---|
| 2024368 | 5/1970 | Fed. Rep. of Germany | 224/328 |
| 243364 | 12/1946 | Switzerland | 224/45 S |

OTHER PUBLICATIONS

Lockable Ski Rack, Mechanix Illustrated, Jan. 1973, pp. #88 & 89.

*Primary Examiner*—Robert J. Spar
*Assistant Examiner*—Jerold M. Forsberg
*Attorney, Agent, or Firm*—Young & Martin

[57] ABSTRACT

An elongated transport container for skis and the like is provided wherein upper and lower matched halves are pivotally connected to form a box-like enclosure. The lower half of the enclosure supports a pair of clamping bars at either end and a pair of skis may be placed on these bars in edge-to-edge relation. The upper half of the container has a pair of matching clamping bars secured at either end, and the clamping bars are positioned so that the closing of the container will clamp the pairs of bars together so as to frictionally lock the skis therebetween. The clamping bars also support mounting brackets for ski poles and the like.

8 Claims, 6 Drawing Figures

SKI TRANSPORT CONTAINER

BACKGROUND OF THE INVENTION

With the increasing popularity of snow skiing in many countries throughout the world, a great number of ski enthusiasts travel substantial distances in order to enjoy this outdoor recreation. Due to the costs and inconvenience involved in obtaining ski equipment at the particular resort destination, and also due to personal preference in using the same equipment, many skiers find it both desirable and practical to transport their ski equipment with them as they travel from place to place. However, since ski equipment may be somewhat susceptible to marring or scratching which both detracts from their appearance and decreases the performance of the equipment, it thus becomes necessary to protect one's skis to as great an extent as possible.

In the past, many skiers have simply wrapped their skis in plastic or placed the skis in plastic or vinyl bags for transport. This has not proved satisfactory, especially since many transportation companies stow the skis with other luggage so that the skis get tossed and joggled around in transport, and, in fact, occasionally may have portions snapped off or the skis may be broken in two. Due to the awkward size of skis, transporting them in the storage compartment of the transport craft has been a necessary evil since they are not readily carried in the passenger compartments of the craft.

Other inventors have recognized this problem and have sought to provide a solution for it. For example, U.S. Pat. No. 3,767,036 to McLeod discloses two substantially identical hinged halves of a carrying case within which the skis may be placed and constrained against movement by means of large masses of sponge-like material. This case also positions the ski boots and ski poles by means of these spongy masses. It is noted, however, that the McLeod patent provides elongated slots which must conform to the ski, and the skis are slightly deformed when placed in the box by means of a clamping brace.

In Swiss Pat. No. 243,343 to Drox, a carrying case is provided wherein a set of skis and poles is entirely protected by the container. The container is a box-like structure which has a pair of grooved members which receive the edge of the skis, and a pair of bridles or blocks mounted on the lid so that when the skis are placed in the box and the lid closed, they retain the skis against the grooved crossbars.

Also, U.S. Pat. No. 3,889,861 to Fihn discloses an elongated container which receives a central portion of the skis with the running faces of the skis adjacent. Slots are provided at the ends of the container so that the skis protrude outwardly therefrom and ski poles may be placed within longitudinal grooves at the exterior edge of the container.

SUMMARY OF THE INVENTION

It is an object of the present invention to provide a novel and improved container for transporting skis and the like.

It is another object of the present invention to provide a transport container for skis and the like which will entirely enclose the skis and secure the skis in suspended relation so as to protect the same from breakage and from damage to their running surfaces.

Another object of the present invention is to provide an elongated container for skis and the like formed of interconnected cover portions and having gripping members advanceable into gripping engagement with opposite flat surfaces of the skis when the cover portions are secured together.

A further object of the present invention is to provide a container including gripping members which securely grip a pair of skis upon closing of the container so as to prevent substantial movement of the skis within the container yet release the skis upon opening of the container and which container may simultaneously contain a plurality of ski poles.

It is yet another object of the present invention to provide a transport container for skis and the like which may readily be stacked with a plurality of similar containers.

A further object of the present invention is to provide an inexpensive yet practical container for carrying skis wherein two halves of the container are formed of an identical structure.

To accomplish these objects, a container or case is provided which has a pair of elongated cover portions, such as, upper and lower matching halves, formed as shells adapted to be placed in confronting relationship whereby their peripheral edges abut one another, the cover portions or shells being hinged or connectable together along lateral edges to form the bottom and lid portions of an elongated box-like structure. These halves pivot between an open and closed position and are of a length such that, when closed, they will encase a pair of skis and the like. Suitable clasps and locks are provided to secure the container in a closed position, and a handle is attached for ease of carrying.

In order to mount a pair of skis in the container, a plurality of clamping members are provided in the container and operate to secure the skis in the closed container by gripping opposite flat surfaces of the skis. In the preferred embodiment, a pair of such members are provided with each pair of the clamping members being formed of a pair of crossbars which has a strip of resilient material mounted thereon. One crossbar of each pair is mounted in the top and bottom half of the container respectively so that when the container is closed, the resilient material of each crossbar of each pair is in abutting relation. Hence, when the container is opened, the crossbars move apart from one another; yet when shut the crossbars will secure a pair of skis placed therebetween by gripping engagement with the opposite flat surfaces thereof. The skis may then be placed on the crossbars when the container is opened, and upon shutting the container the skis become firmly secured in suspended relation within the container. The crossbars are also provided with upstanding resilient blocks with pole receiving bores cut therein so that a plurality of ski poles may also be secured within the container.

These and other objects of the invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
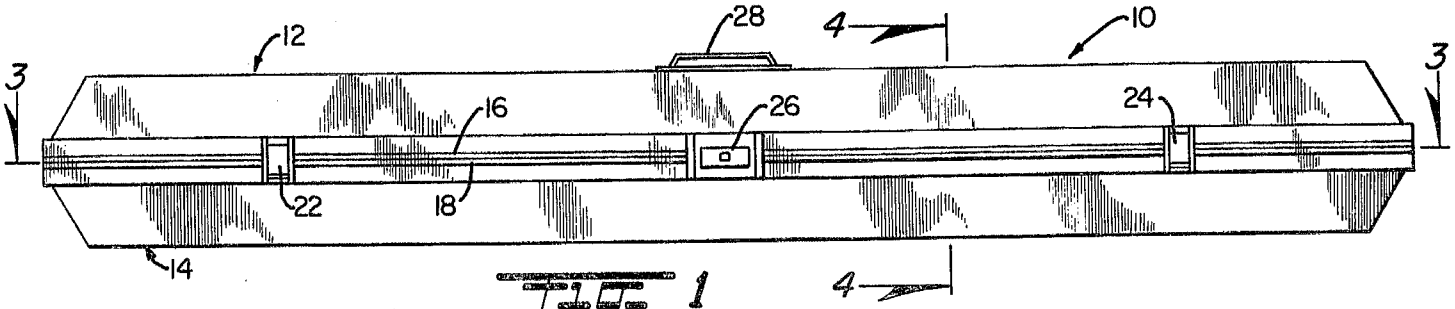
FIG. 1 is a front view in elevation of the ski container according to the preferred embodiment of the present invention shown in a closed position.
Figure 2:
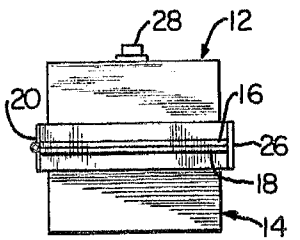
FIG. 2 is an end view in elevation of the ski container shown in FIG. 1.

The preferred embodiment of the present invention defines a ski container or case having elongated trough-shaped members which pivot together to form an enclosure in the form of a hollow, elongated chamber and which has means mounting a pair of skis and poles therein. As may be seen in FIG. 1, ski transport case or container 10 has a pair of case-forming members such as a first cover portion or upper section 12 and a second cover portion or lower section 14 which have abutting peripheral edges 16 and 18, respectively. Upper section 12 and lower section 14 are constructed identically with upper section 12 being inverted to form a lid for the enclosure bottom, namely, lower section 14. Hinges 20 pivotally attach sections 12 and 14 together along one longitudinal edge and clasps or latches 22 and 24 cooperate with lock 26 to fasten the two sections together so that container 10 is in a closed position. Handle 28 is centrally positioned on upper section 12 and is provided to facilitate carrying the ski container.

Upper section 12 and lower section 14 are constructed out of molded plastic in the preferred embodiment, but other materials could be suitably substituted. Further, while in the preferred embodiment the cover portions 12 and 14 are hinged along common lateral edge portions, such pivotal interconnection could be eliminated with other connecting means, such as clasps, substituted in place of the hinges. However, it is thought that the hinge connection is the most practical and convenient.

Figure 3:
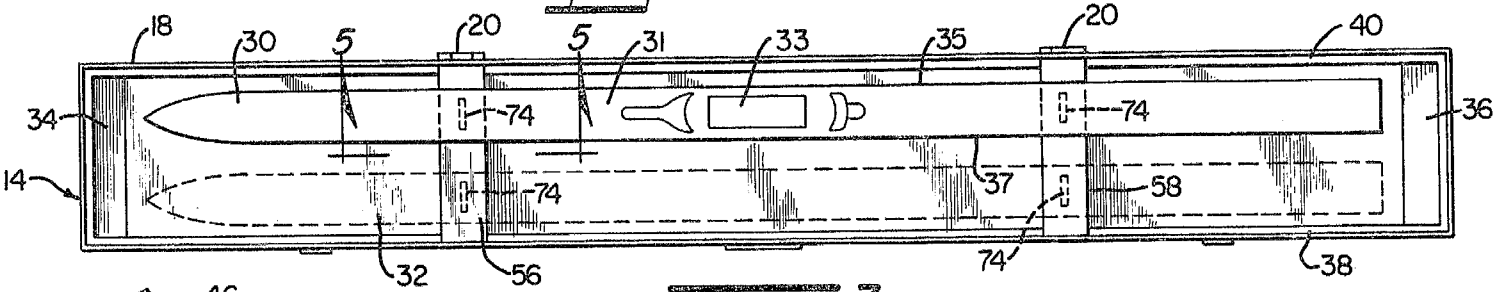
FIG. 3 is a cross-sectional view taken along lines 3—3 of FIG. 1.
Figure 4:
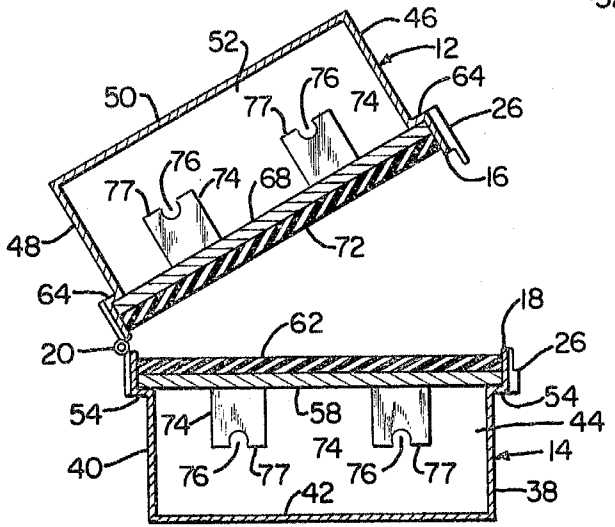
FIG. 4 is a cross-sectional view taken about line 4—4 of FIG. 1, with the container shown in a partially opened position.
Figure 5:
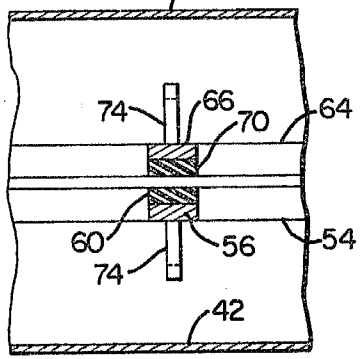
FIG. 5 is a cross-sectional view taken along line 5—5 of FIG. 4.

The internal ski support structure of container 10 is shown in more detail in FIGS. 3, 4 and 5. Lower section 14 is shown in FIG. 3 with a first ski 30 shown placed therein and a second ski 32 shown in phantom. As is well known, a ski has a pair of flat surfaces, one being used for mounting boot bindings, and the other being known as the running surface, that is, the surface which contacts the ski medium, and a pair of edge surfaces. Ski 30 has a mounting surface 31 supporting binding 33 with it to be understood that the running surface is opposite surface 31. Edges 35 and 37 are also designated in FIG. 3. As should be apparent in FIG. 3, lower section 14 has two end walls 34 and 36 and sidewalls 38 and 40. Bottom wall 42 extends along the underside of lower section 14 so as to define a hollow interior 44 therein. End walls 34 and 36 form an obtuse angle with bottom wall 42 so that they diverge from one another. Upper section 12 is constructed substantially identical to lower section 14 and has a pair of end walls (not shown), a pair of sidewalls 46 and 48 and a top wall 50 to form hollow interior 52 shown in FIG. 4.

As best seen in FIG. 4, lower section 14 has a shoulder 54 extending around its perimeter just below peripheral edge 18. A pair of cross members or clamp bars 56 and 58 extend between shoulder 54 on sidewalls 38 and 40 and are mounted thereon by any convenient manner such as glue or screws. Clamp bar 56 and 58 each support a resilient, compressible strip or pad also mounted by any convenient manner known in the art. As shown in FIG. 4, clamp bar 58 supports resilient pad 60 and it is to be understood that clamp bar 56 also supports an identical resilient pad. As noted, upper section 12 is constructed virtually identical to that of lower section 14 and has a shoulder 64 which extends around its perimeter in closely-spaced relation with peripheral edge 16. Again a pair of clamp bars 66 and 68 extend between and are mounted on shoulder 54 on opposite sidewalls 46 and 48 and each of these clamp bars respectively mount resilient pads 70 and 72 in a manner similar to that of clamp bars 56 and 58. Each clamp bar 56, 58, 66 and 68 can be constructed of a variety of materials, such as wood, metal, or plastic and each supports a pair of generally rectangular resilient blocks 74 on a side opposite its associated resilient pad. Resilient blocks 74 may be glued or epoxied to their associated clamp bars or mounted in any other convenient manner, and each has a cutout portion or bore 76 which is generally circular with a small portion of its circle intersecting the edge 77 of block 74 opposite its attachment to its associated clamp bar. Of course, other suitable brackets could be substituted for blocks 74.

It should also be appreciated that the ski container of the present invention need only provide a plurality of gripping members, such as crossbars 56, 58, 66 and 68, which frictionally secure a pair of skis by means of gripping engagement with the opposite flat surfaces of each ski. Further, it is not necessary that each pair of crossbars meet in facing relation as it is quite acceptable to have the various crossbars offset from one another. Indeed, there can even be an odd number of crossbars so that the use of matching pairs of crossbars is unnecessary.

Use of the ski container according to the preferred embodiment of the present invention should be now appreciated from an understanding of the specific construction as described above. When a user desires to transport a pair of skis, such as, for an airline flight or other carriage, the skier simply opens the container so that upper section 12 is pivoted away from lower section 14 so that peripheral edges 16 and 18 are no longer in abutting relation. This opens the pair of clamps defined by crossbars 56 and 66 and 58 and 68, respectively, since the crossbars operate as jaws of a pair of clamps. As shown in FIG. 3, the skier then places skis 30 and 32 on the resilient pads supported by the crossbars 56 and 58 in lower section 14. A pair of ski poles may be mounted by resilient blocks 74 in either the upper or lower section of the container. This is achieved by simply slipping the ski pole between the crossbar and the top or bottom wall of the associated container and then locking the pole in bores 76 of the resilient blocks 74. When the container is closed, the clamp bars are pivoted together as shown in FIG. 4 so that the resilient pads of the pair of clamp bars are placed in abutting relationship. In this manner, skis 30 and 32 become frictionally locked between the pairs of clamp bars and are suspended from contact with the top and bottom walls of the container. In this manner, also, both the skis and the ski poles are protected during transit from one location to another and, when several containers are stacked, the ends of which may be easily grasped by virtue of the obtuse end walls since the container thereby has generally pointed ends.

With the above function in mind, it should also be appreciated that resilient pads 60, 62, 70 and 72 may be constructed of a variety of material such as sponge or soft rubber. Indeed, these pads may be constructed of a rubber strip or the like with the only requirement that they be conformable to the shape of the ski so as to frictionally engage and secure a pair of skis between the crossbars. Further, it is necessary that the crossbars be spaced a sufficient distance part by means of shoulders 54 and 64 so as to conform to the thickness of a pair of skis. Likewise, bore 76 of resilient blocks 74 must be dimensioned to frictionally secure a ski pole therein and to prevent accidental disengagement of the pole with the block. Therefore, the edges of resilient block 74 adjacent cutout portion 76 should yieldingly retain the pole within the cutout portion.

As may be seen in FIG. 4, a total of four ski poles may be carried by the present invention, and it should be appreciated that it is often desired to transport two pairs of skis, that is, four individual skis. For this reason, in the preferred embodiment, shoulders 54 and 64 are positioned a sufficient distance away from peripheral edges 18 and 16 respectively and clamp bars 65, 58, 66 and 68 and their associated resilient pads 60, 62, 70 and 72 are dimensioned to receive the thickness of two skis therebetween. Specifically, the skis are positioned in the container so that the running or glide surfaces of a pair of skis are in abutting relation. By having the running surfaces abutting, the ski tips or pointed ends of the skis diverge away from one another. When the container is closed, the skis are locked in position by friction placed on the mounting surface of each ski by the resilient pads and the skis are retained against one another by friction along their running surfaces.

Figure 6:
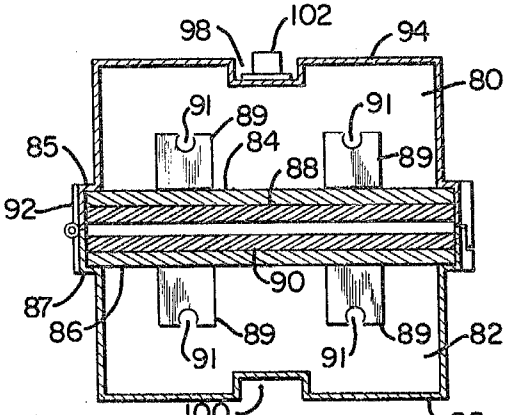
FIG. 6 is a cross-sectional view of an alternate embodiment of the ski container

FIG. 6 shows a modified version of the container and an alternative construction for the upper and lower sections. In FIG. 6, upper section 80 and lower section 82 are constructed similarly to upper section 12 and lower section 14 discussed above. Each has shoulders 85 and 87 for mounting crossbars 84 and 86 which support resilient pads 88 and 90 respectively as well as resilient blocks 89 which have bores 91 as in the preferred embodiment. Similarly to container 10, upper section 80 is hinged to lower section 82 by means of hinge 92. The difference between the construction as discussed above and that in the modified embodiment is that top wall 94 and bottom wall 96 are provided with recessed portions 98 and 100 respectively. Recessed portion 98 receives handle 102 and needs only to be of such dimension longitudinally to mount handle 102. By providing recessed portions 98 and 100, the stacking of a plurality of containers 78 is facilitated since bottom panel 104 and 106 on one container will abut top panels 108 and 110 on an adjacent container, respectively. In this manner, the handles will not get in the way so that a smooth, stable stacking may be accomplished. Stacking may be enhanced by also placing mating nubs and dimples at the corners of the bottom and top walls.

In the case of either container 10 or container 78, it should be readily appreciated that the lower section and the upper section may be formed of a rigid plastic material or any other suitable substance. Further, the sections are identical in form so that they may be formed from a common mold or press for ease of construction. In this manner, then, both economy and ease of manufacture are achieved. Of course, wood, sheet metal or combinations of metal and plastic-like materials including vinyls could be readily utilized in constructing the present invention.

Although the present invention has been described with a certain degree of particularity, it is understood that the present disclosure has been made by way of example and that changes in details and structure may be made without departing from the spirit and scope as defined by the appended claims.

I claim:

1. In an elongated container for transporting skis and ski poles wherein said container comprises a bottom chamber member having a bottom wall, a pair of sidewalls and a pair of end walls, and an upper lid member having a top wall, a pair of sidewalls and a pair of endwalls, said bottom chamber member and said upper lid member hinged together and being pivotal between a closed position defining an enclosed chamber and an open position, and means to releasably secure said lid member to said chamber member when they are in said closed position the improvement comprising: a pair of clamp members mounted in the chamber defined by said chamber member and said lid member, each said clamp member including first and second jaw members having facing surfaces, said facing surfaces each having a resilient member mounted thereon, said clamp member adapted for frictionally retaining a ski in suspended relation within said chamber, each said first jaw member being mounted in said upper lid member in spaced-apart parallel relation to said top wall and each said second jaw member being mounted in said bottom chamber member in spaced-apart parallel relation to said bottom wall, whereby said jaw members are moved into and out of clamping engagement as said lid member and said chamber member are moved into and out of said closed position, respectively; and support means on one of said first and second jaw members for postively supporting an article from the surface of said jaw member opposite its said facing surface.

2. In a transport container according to claim 1, said first jaw member being mounted to extend transversely of the length of said bottom chamber member between respective ones of said sidewalls and said second jaw member being mounted to extend transversely of the length of said lid member between respective ones of sidewalls, each of said sidewalls having a shoulder portion positively supporting a mounting surface of each said jaw member mounted therein opposite said facing surface, said resilient members being in abutting relation when said container is in said closed position and said jaw members and said resilient members being in spaced-apart relation when said container is in the open position.

3. In a transport container according to claim 2, said support means including a plurality of resilient blocks each having a bore therethrough, said bore intersecting an edge surface of said block.

4. A transport case adapted for storing and carrying skis and ski poles, comprising:

first and second elongated case-forming members each having a bottom wall, a pair of end walls and a pair of elongated sidewalls, said case-forming members each having an upper peripheral edge defined by the upper edges of its end walls and sidewalls, one of said first and second case-forming members being inverted on the other of said first and second case-forming members, said peripheral edge of one of said case-forming members adapted to abut said peripheral edge of said other case-forming member to define an enclosed chamber between said case-forming members;

a hinge member pivotally interconnecting said peripheral edges of said first and second case-forming members along adjoining sidewalls for pivotal movement between an open position and a closed position, said pivotal movement being along an axis defined by a peripheral edge of one of said sidewalls of each of said case-forming members, and means to releasably secure said first and second case-forming members in said closed postion;

first and second clamp bars mounted in a common plane between the sidewalls of said first case-forming member and third and fourth clamp bars mounted in a common plane between the sidewalls of said second case-forming member, said first and third clamp bars positioned to form a first facing pair of clamp bars having first surfaces opposed to one another when said peripheral edges are in abutting relation and said second and fourth clamp bars positioned to form a second facing pair of clamp bars having first surfaces opposed to one another when said peripheral edges are in abutting relation, said clamp bars each having second surfaces on a side thereof opposite said first surfaces, said sidewalls of said first and second case-forming members each including a support portion positively supporting the second surfaces of respective ones of said clamp bars so that said clamp bars are each positioned in spaced-apart parallel relation to the bottom wall of its respective case-forming member in the interior of said case; support means for releasably retaining and positively supporting said ski poles entirely within said enclosed chamber, said support means being secured to the second surfaces of the clamp bars mounted in at least one of said case-forming members; and frictional engaging means secured to the first surfaces of said clamp bars adapted for frictionally retaining a ski therebetween.

5. A transport case according to claim 4, wherein said case-forming members being generally trough-shaped and substantially symmetrical about a plane defined by said peripheral edges when said peripheral edges are in abutting relation.

6. A transport case according to claim 4, said support portion of each case-forming member being a shoulder extending along its perimeter adjacent its peripheral edge and projecting into the interior of said chamber, said clamp bars being secured to an associated one of said shoulder.

7. A transport case according to claim 4, wherein said support means includes a resilient block mounted on each of said first and second facing pairs of clamp bars on a second surface of respective clamp bars in one of said case forming members, said blocks each including a bore extending therethrough, each said bore intersecting an edge surface of its associated said block and adapted to receive a shank of a ski pole.

8. A transport case according to claim 4, wherein said bottom wall of each said first and second case-forming members includes a recessed portion at a medial location thereof, and including a handle mounted in the recessed portion of one of said first and second case-forming members.

* * * * *